US009077118B2

(12) United States Patent
Szu et al.

(10) Patent No.: US 9,077,118 B2
(45) Date of Patent: Jul. 7, 2015

(54) ELECTRICAL CONNECTOR WITH IMPROVED CONTACTING PORTIONS

(71) Applicant: HON HAI PRECISION INDUSTRY CO., LTD., New Taipei (TW)

(72) Inventors: Ming-Lun Szu, New Taipei (TW); Chien-Ping Kao, Hershey, PA (US); Tsu-Yang Wu, New Taipei (TW); Sheng-Ko Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 186 days.

(21) Appl. No.: 13/846,869

(22) Filed: Mar. 18, 2013

(65) Prior Publication Data

US 2014/0273652 A1 Sep. 18, 2014

(51) Int. Cl.

*H01R 24/00* (2011.01)
*H01R 13/658* (2011.01)
*H01R 13/6471* (2011.01)

(52) U.S. Cl.

CPC ..... *H01R 13/65807* (2013.01); *H01R 24/00* (2013.01); *H01R 13/6471* (2013.01)

(58) Field of Classification Search

USPC ..... 439/660, 79, 374, 607.08–607.11, 439/607.28, 607.34, 378, 636, 674, 677, 439/640, 151, 246, 247, 633.638, 680, 439/752.5, 633

See application file for complete search history.

(56) References Cited

U.S. PATENT DOCUMENTS

| | | | | |
|---|---|---|---|---|
| 6,832,934 | B1 * | 12/2004 | Zhang | 439/660 |
| 7,485,009 | B1 | 2/2009 | Zhu | |
| 7,909,652 | B2 * | 3/2011 | Yang et al. | 439/660 |
| 8,342,886 | B2 | 1/2013 | Zhang et al. | |
| 8,353,726 | B2 | 1/2013 | Zhang et al. | |
| 2012/0077389 | A1 * | 3/2012 | Zhang et al. | 439/660 |
| 2012/0108109 | A1 * | 5/2012 | Zhang et al. | 439/629 |

FOREIGN PATENT DOCUMENTS

| | | |
|---|---|---|
| TW | M422802 | 2/2012 |

OTHER PUBLICATIONS

Enterprise SSD Form Factor Version 1.0 p. 12 , dated Dec. 20, 2011.

* cited by examiner

*Primary Examiner* — Abdullah Riyami
*Assistant Examiner* — Harshad Patel
(74) *Attorney, Agent, or Firm* — Wei Te Chung; Ming Chieh Chang

(57) ABSTRACT

A plug connector includes a housing with a rear base and a front mating tongue in a mating direction and a plurality of terminals arranged in the housing in a lateral direction. The front mating tongue defines a first face and a second face. The first side defines a rib thereby the first face being divided to a first mating face, a third mating face and a second mating face on the rib. The second face is defined as a fourth mating face. The terminals include plate portions exposed upon the mating tongue and mounting legs outside the housing. The terminals are divided to four groups, the plate portions of the four groups are exposed upon the mating faces respectively. Each of the first and second groups of terminals includes grounding terminals and differential signal pairs, the plate portions of the differential signal pairs have a length equal to 3.2 mm.

7 Claims, 8 Drawing Sheets

ELECTRICAL CONNECTOR WITH IMPROVED CONTACTING PORTIONS

BACKGROUND OF THE INVENTION

1. Field of the Invention

The present invention generally relates to an electrical connector capable of high speed, and more particularly to an electrical connector which has a high speed up to 24 Gbps and backwards compatibility with relative lower high speed connector.

2. Description of Related Art

Serial Attached SCSI (SAS) is a successor to the parallel SCSI and is also based on serial technology. Besides the advantage of higher-speed signal transmission, another most significant advantage is that the SAS interface will also be compatible with SATA drives. T10, a Technical Committee of Accredited Standards Committee INCITS (International Committee for Information Technology Standards) issued a Serial Attached SCSI-2.1 (SAS-2.1) on 2012, in which the SAS connector transmits 6.0 Gbps per each data channel, and T10 is going to a gate of 12 Gbps. The 12 Gbps connector back to conventional 6 Gbps connector is further equipped with a common grounding bar connecting with grounding terminals interposed between every differential pair of signals Such features are defined in U.S. Pat. Nos. 8,353,726 and 8,342,886 assigned to a same assignee with this patent application.

A SSD Form Factor Working Group (http://www.ssdformfactor.org) publics an industry standard <Enterprise SSD Form Factor Version 1.0> at Dec. 20, 2011, which focuses on extending the existing connector for PCIe use. The new connector back compatible extension of the existing SAS connector is now up to a 12 Gbps data transmission speed. As known, it is needed to get a higher-speed electrical connector and backwards a relative lower speed connector under an irreversible trend of mass and higher speed data transmission.

In view of the foregoing, an improved higher-speed connector would be desirable.

SUMMARY OF THE INVENTION

Accordingly, an object of the present invention is to provide an electrical connector with a high speed up to 24 Gbps.

In order to achieve the object set forth, a plug connector comprises a housing defining a rear base and a front mating tongue in a mating direction and a plurality of terminals arranged in the housing in a lateral direction perpendicular to the housing. The front mating tongue defines a first face and a second face opposite to the first face, the first side defines a rib thereby the first face being divided to a first mating face, a third mating face and a second mating face on the rib and between the first and third mating face. The second face is defined as a fourth mating face. The terminals comprise plate portions exposed upon the mating tongue and mounting legs outside the housing. The terminals are divided to four groups, the plate portions of a first group of terminals exposed upon the first mating face, the plate portions of a second group of terminals exposed upon the second mating face, the plate portions of a third group of terminals exposed upon the third mating face, the plate portions of a fourth group of terminals exposed upon the fourth mating face. Each of the first and second groups of terminals comprises grounding terminals and differential signal pair, the plate portions of the differential signal pairs of the first and second groups have a length equal to 3.2 mm.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
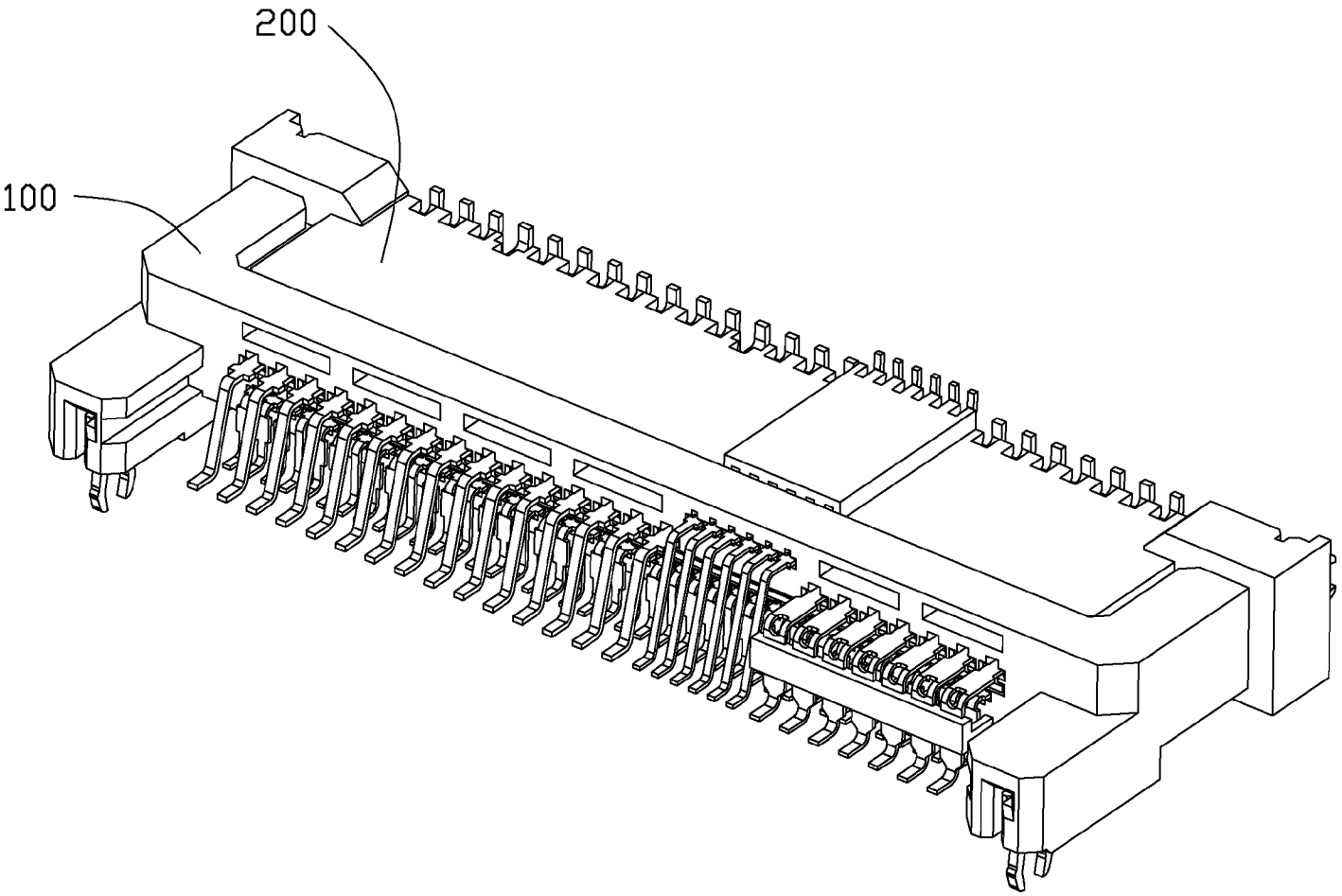
FIG. 1 is a mated perspective view of an electrical connector assembly of an embodiment in accordance with the present invention.
Figure 2:
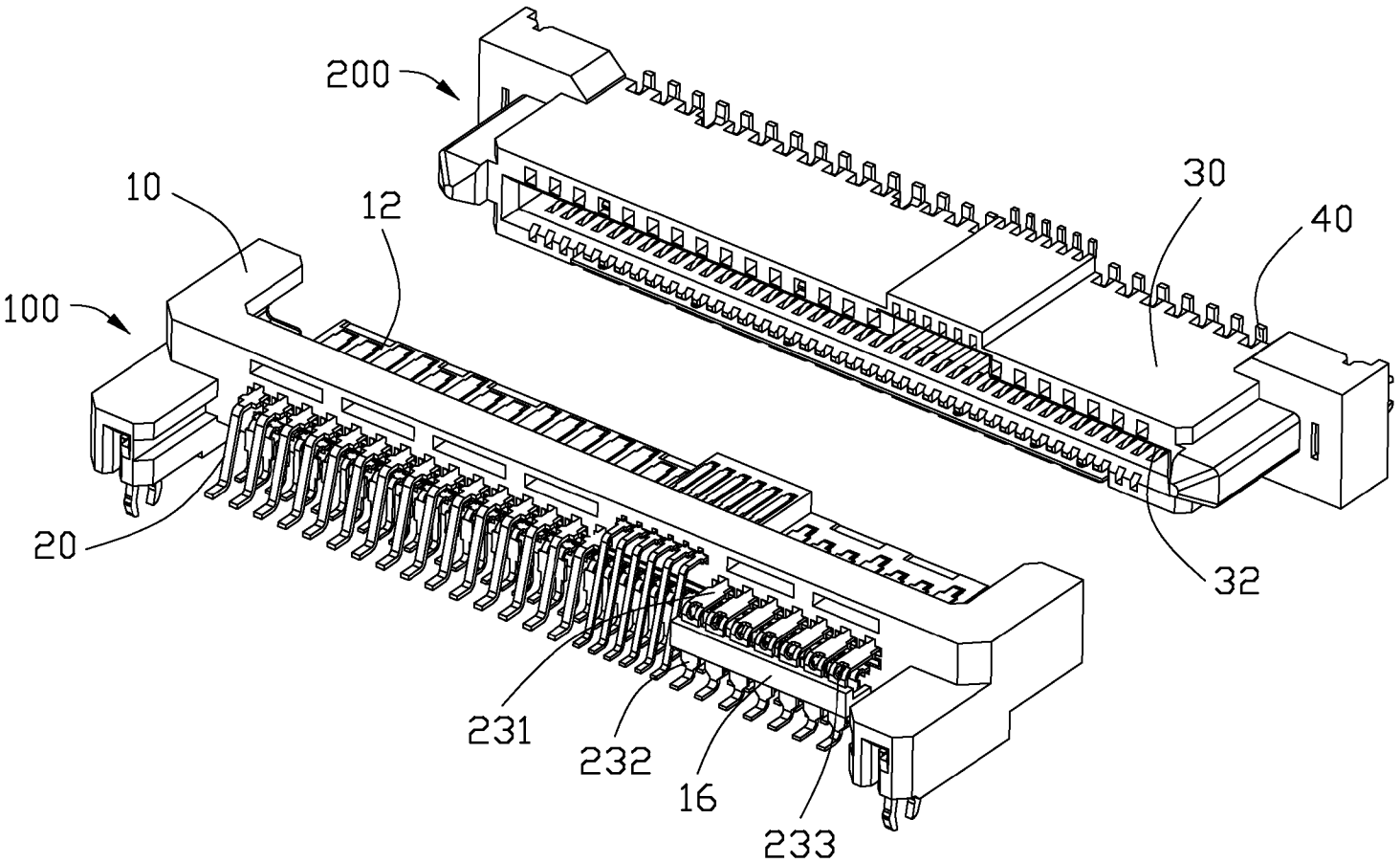
FIG. 2 is a perspective view of the electrical connector assembly shown in FIG. 1, wherein two connectors disconnect from each other.

Referring to FIGS. 1 and 2, an electrical connector assembly is provided an interface for a high speed storage device, especially for SAS and signal transmission which is capable of operation up to 24 Gps. The assembly includes a first/plug connector 100 and a second/receptacle connector 200 mated with each other. The second connector 200 is backwards compatible with current standard SAS and Serial ATA plug connector. Optionally, the plug connector 100 in this embodiment constitutes a right angle connector, the receptacle connector 200 constitutes a vertical type connector. The first connector 100 includes a housing 10 made from insulating material with a front mating tongue 12 and a plurality of conductive terminals 20 held in the housing. The receptacle connector 200 includes a housing 30 made from insulating material with a mating slot 32 and a plurality of conductive terminals 40. The mating tongue 12 is plugged into the mating slot 32 when the two connectors are engaged with each other in a mating direction.

Figure 3:
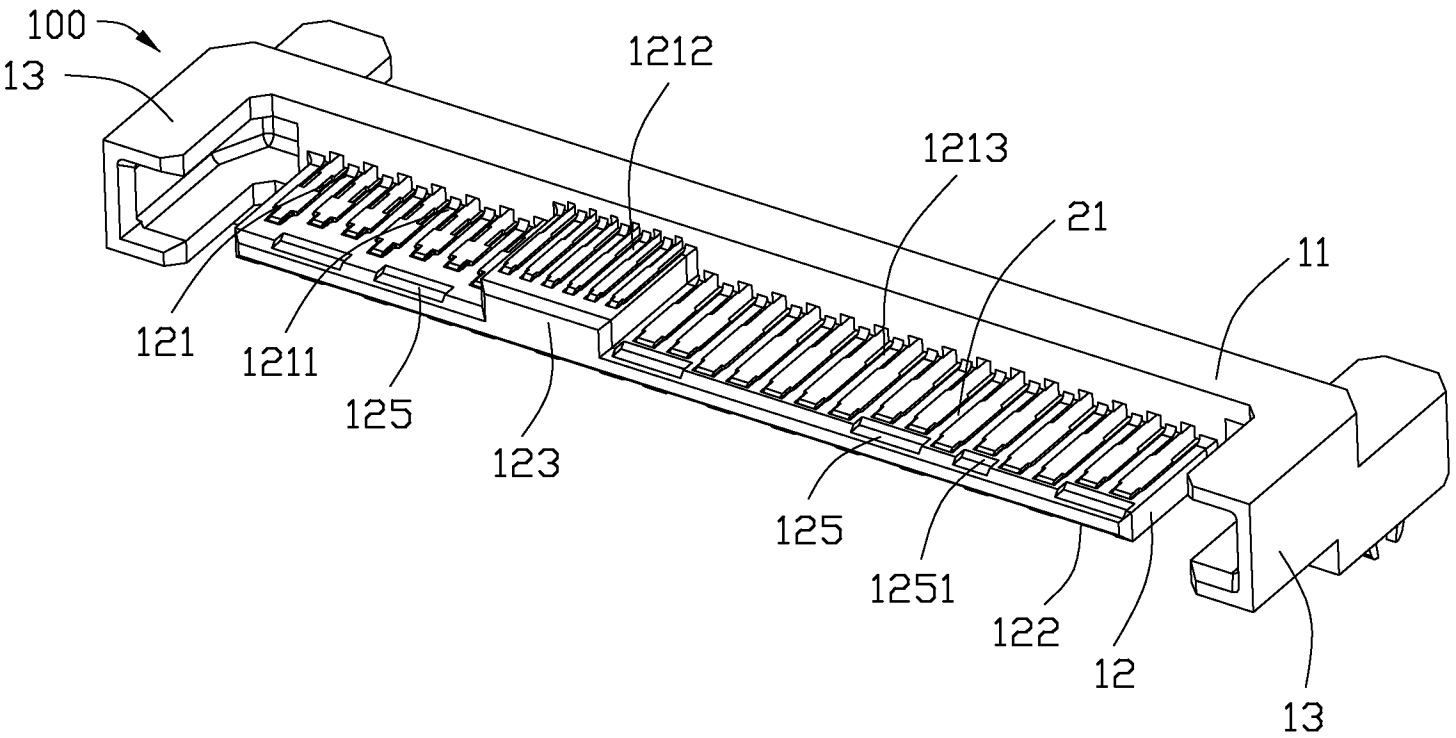
FIG. 3 is a perspective view of a plug electrical connector shown in FIG. 1.
Figure 4:
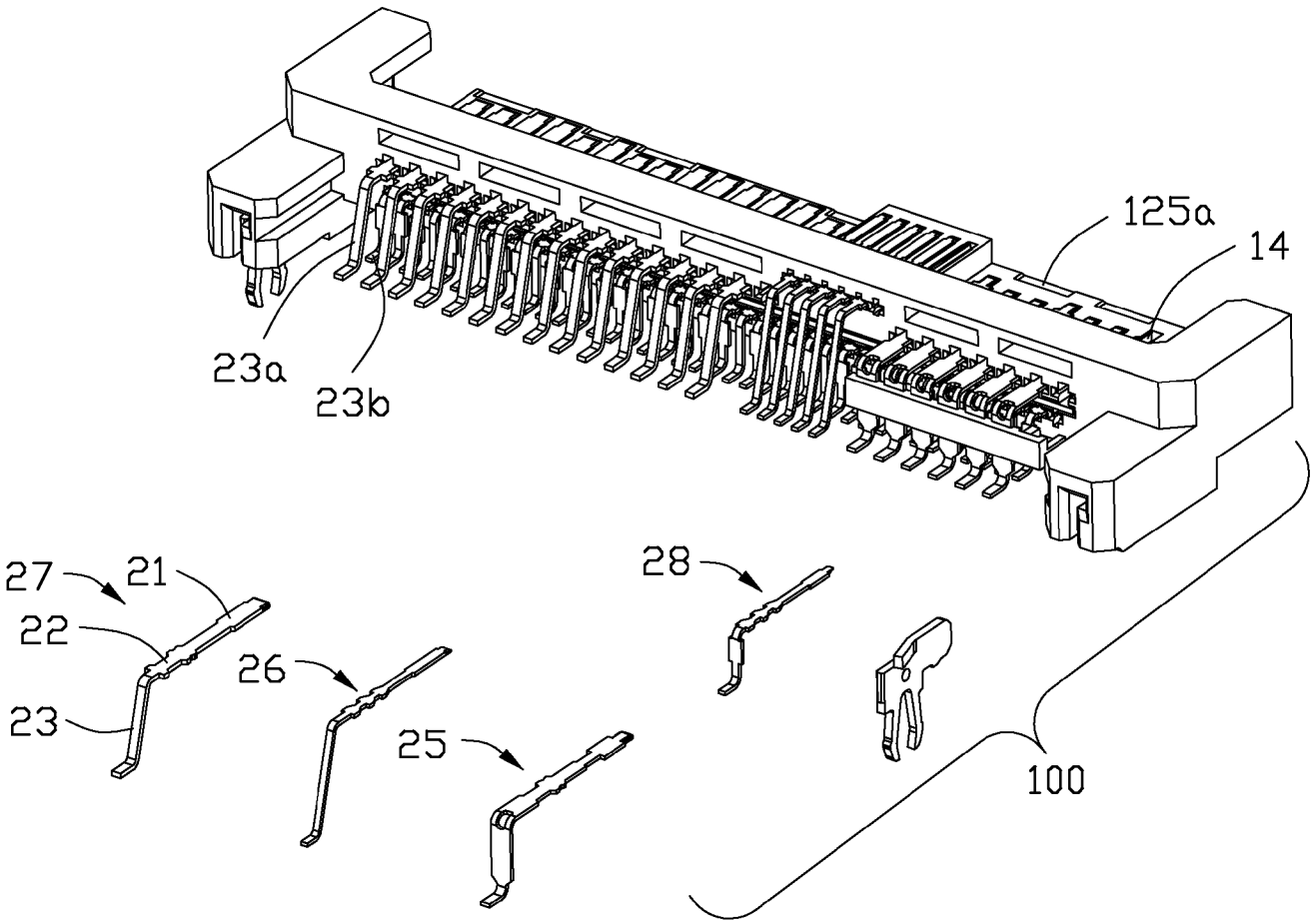
FIG. 4 is an exposed perspective view of the plug connector shown in FIG. 3.

Referring to FIGS. 3 and 4, the front mating tongue 12 extends forwards from a longitudinal rear base 11, a pair of inverted U shaped guiding portions 13 extending from the rear base is located at two ends of the mating tongue 12 and separates from the mating tongue 12. The mating tongue 12 defines a first face 121 and a second face 122 opposite to the first face. The mating tongue 12 defines a keying rib 123 at the first face 121, which divides the first face 121 to a first section 1211 and a second section 1213. Therefore, the first face 121 is provided with a first mating face (i.e, the first section 1211) therealong and a third mating face (the second portion 1213) lower than a second mating face 1212 (i.e., the face at the keying rib 123) sequentedly from a lateral direction or a longitudinal direction perpendicular to the mating direction. The second face 122 is provided with a fourth mating face. The housing 10 defines a plurality of terminal grooves 14 exposed upon said four mating faces. The terminals 20 are similar in shape, which are planar and have bars along lateral sides thereof, thus only one terminal is numbered for simplicity. The terminals 20 comprise plate contacting portions 21 accommodating in the terminal grooves 14 and exposed upon said four mating faces. The contacting portions 21 extend in the mating direction and have a length from a front edge of the contacting portion to the root of the rear base 11. Combined with FIG. 4, the terminals comprises retained portions 22 with said bars retained with the housing and mounting legs 23 located along a rear end of the housing 10. The contacting portions 21 and connecting legs 23 extend from the retained portions 22 oppositely, and the contacting portions and the retained portions are in a same planar. The contacting portion 21 substantially is designated a portion of each terminal exposed upon the mating faces of the mating tongue 12. The mounting legs 23*a* of the terminals on the first face are arranged in one row behind the mounting legs 23*b* of the terminals on the second face. The terminals 20 of the plug connector 100 in this embodiment includes three groups located at the first face 121 and one group at the second face 122. One or two terminals are removed from the housing for clarify in FIG. 4.

Figure 5:
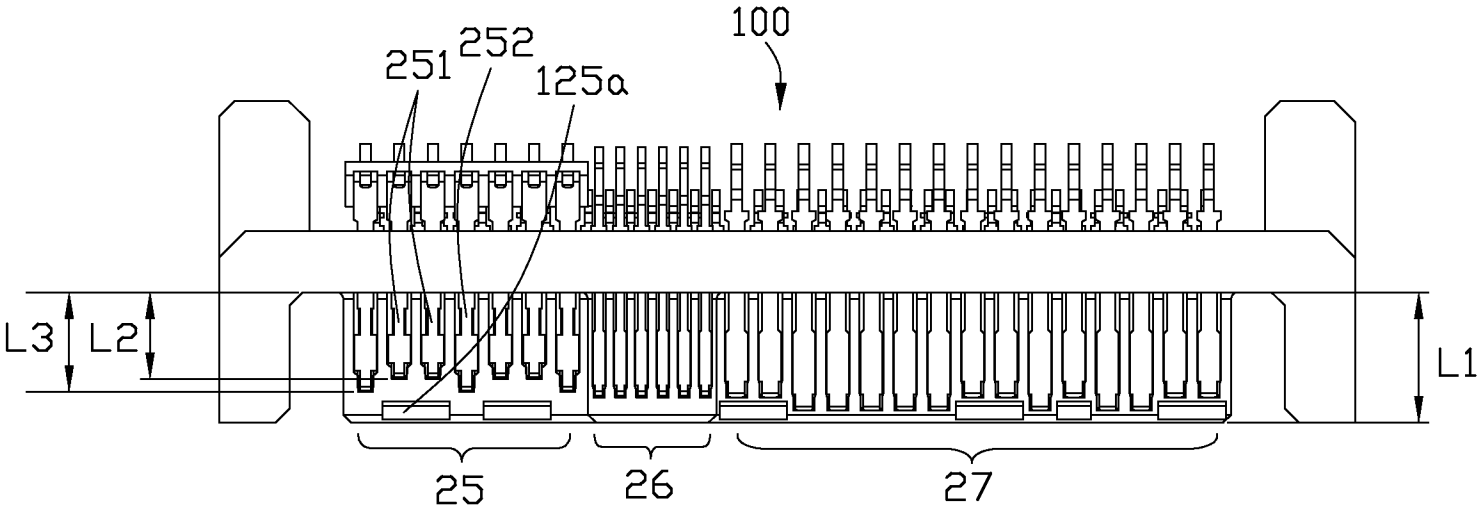
FIG. 5 is a top plan view of the plug connector shown in FIG. 3.
Figure 6:
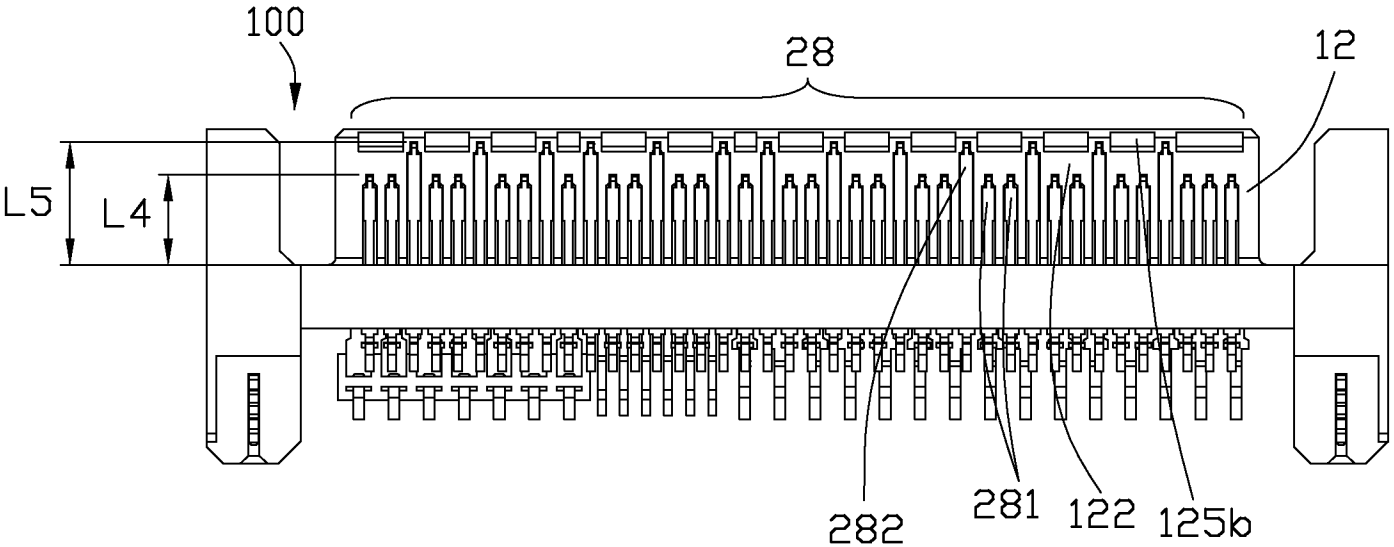
FIG. 6 is a bottom plane view of the plug connector shown in FIG. 3.

Combination with FIGS. 5 and 6, a first group of terminals referenced as 25 is located at the first mating face, which includes signal terminals 251 arranged in pairs and grounding terminals 252 arranged between corresponding signal terminals Generally, said each pair of signal terminals consisting of two adjacent signal terminals constitutes a differential signal pair and the grounding terminals constitute signal-grounding terminals. The grounding terminals 252 separate the differential signal pairs, respectively. The mating tongue 12 has a predetermined length L1 from the front edge thereof to a root of the mating tongue 12 jointed with the rear base 11 of the housing in the mating direction. Each terminal 251 of the differential signal pairs has a length L2 (L2=3.2 mm) and each of the grounding terminals has a length L3 (L3=3.9 mm) Said two lengths L1, L2 are shorter than corresponding lengths of currently electrical connectors which are defined in "Enterprise SSD Form Factor Version 1.0". The mating tongue 12 defines cutouts 125*a*, running through the front face of the mating tongue 12 and the first faces. The cutouts are just aligned with the differential signal pairs in the mating direction. The front edges of the differential signal pairs of the first group do not arrives the cutouts 125*a*, while the front edges of the grounding terminals 252 of the first group project forwards beyond the cutouts 125*a*. A second group of the terminals referenced as 26 also include differential signal pairs and grounding terminals alternatively arranged with the differential signal pair. The front portions of the differential pairs are aligned with that of the differential signal pairs of the first group of the terminals. A third group of the terminals referenced as 27 is served as power terminals Referring to FIG. 6, the fourth group of terminals referenced as 28 in the second mating face, includes differential signal pairs 281 and grounding terminals 282. Each terminal of the differential signal pairs has a length L4 (L4=3.2) in the mating tongue 12 along the mating direction and each terminals of the grounding terminals 282 has a length L5 in the mating tongue. A plurality of cutout 125*b* is also defined in front edge of the second face of the mating tongue 12. The front edges of the differential signal pairs 281 are located behind the cutouts 15*b* and the front edges of the grounding terminals 282 project beyond the cutouts 125*b*. The length dimensions of the contacting portions exposed in the mating tongue are shorter, resulting that electrical paths of terminals are developed to get a higher resonance frequency of the electrical connectors which benefits higher speed of signal transmission. The thickness of the terminals is thinner and equal to 0.15 mm.

The cutouts 125*a*, 125*b* opens forwards and corresponding mating faces, which is not only reduce an inserting force of the electrical connectors, but also provide a datum of the terminals, especially of the differential signal pairs. The cutout defines a rear face 1251 which is defined as a datum line DL. The differential signal pairs of the terminal 20 are located behind the datum line, the grounding terminals of the first group 25 are located behind the datum. The terminals of the second group 26 including grounding terminals and differential signal pair are located behind the datum. The grounding terminals of the third group are the project forward beyond the datum line DL.

Back to FIG. 4, the terminals of the first group 25 are wider in the lateral direction, which substantially approach to that of the second group 26 for power transmission. Back to FIG. 2, the mounting legs 23 of the terminals of the first group 25 are integrally molded with an insulating block 16. The mounting legs 23 includes a horizontal portion 231 and a vertical portion 232, a hole 233 is disposed at the bending point of the mounting leg. The holes 233 and the insulating block 16 are used for adjusting matching impedance of the terminals of the first group.

Figure 7:
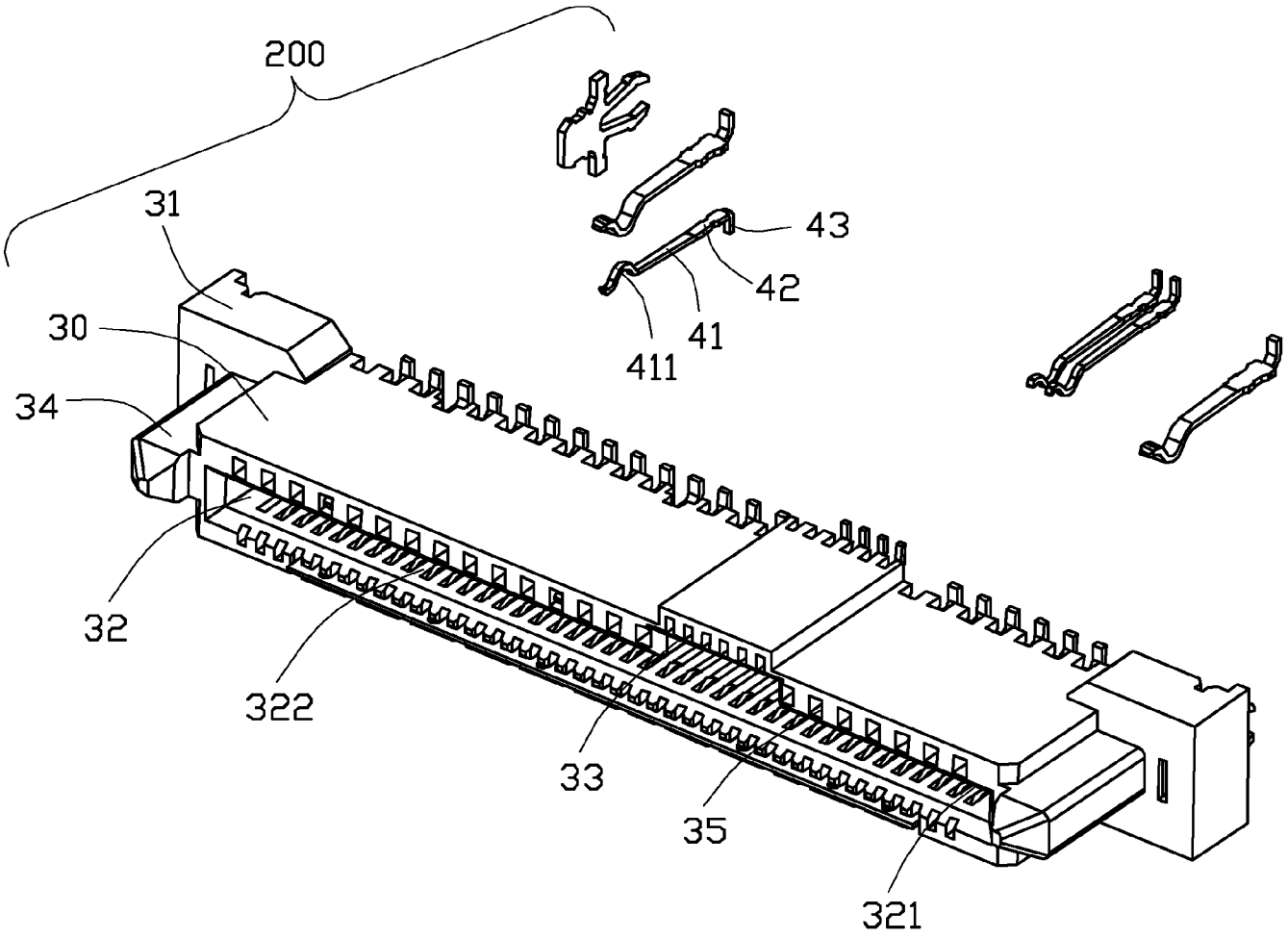
FIG. 7 is an exposed perspective view of a receptacle electrical connector shown in FIG. 2.

Referring to FIG. 7, the front-opening mating slot 32 of the second connector 200 surrounds with side walls extending from a base 31 and a pair of guiding posts 34 integrally with the side walls. The mating slot 32 defines three mating face in a first inside 321, a fourth mating face at a second inside 322. Said four mating faces in the insides of the second electrical connector 100 are disposed corresponding to the said four mating faces of the first electrical connector 100. The first inside 321 have a groove 33 running through a front face of the housing, which correspondingly receives the rib 123 of the first connector 100. A plurality of terminal grooves 35 is disposed upon said insides. The terminals 40 are shaped in a similar form, which comprise elastic contacting portion 41 exposed to the mating slot 32, retained portions 42 retained in the housing and mounting legs 43 extending outside the housing. The contacting portions 41 have arc portions 411 projecting into the mating slots 32 to engage with planar contacting portions of the first contacting portion.

The terminals 40 are divided to four groups. The terminals have no changed dimensions along the mating direction, while width dimensions along a longitudinal direction perpendicular to the mating direction. Each terminal of a first group is wider than corresponding terminals of the conventional electrical connector, which has a width D1 (D1=0.65 mm) at a root connecting with the retaining portion and a width D2 (D2=0.54) at the contacting portion. Each terminals of a fourth group also have a larger width D3 (D3=0.38 mm) The second and third groups keep on a conventional dimension.

Figure 8:
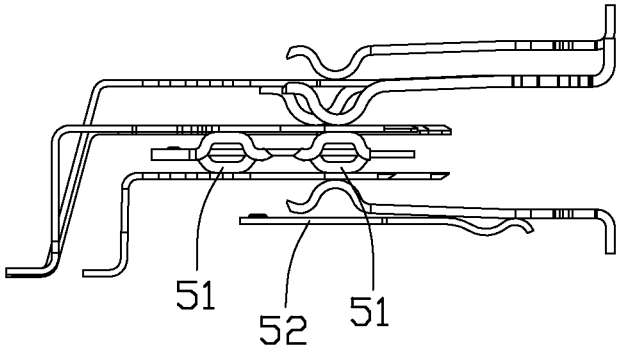
FIG. 8 is a side elevation view of the assembly without housing removed.

Optionally, the first and second electrical connectors are equipped with grounding bars to further reduce an electrical length to higher an enlarged resonance frequency. Referring to FIG. 8, the first connector 100 further comprises two grounding bars 51 connecting with grounding terminals and the second connector 200 further comprises a grounding bars 52 connecting with grounding terminals optionally, for further reduce grounding electrical path to obtain higher resonance frequency of the connector assembly.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. A plug electrical connector comprising:

a housing comprising a rear base and a front mating tongue in a mating direction, the front mating tongue defining a first face and a second face opposite to the first face, the first face defining a rib thereby the first face being divided to a first mating face, a third mating face and a second mating face on the rib and between the first and third mating face, the second face being defined as a fourth mating face;

a plurality of terminals arranged in the housing in a lateral direction perpendicular to the housing and comprising plate portions exposed upon the mating tongue and mounting legs outside the housing;

the terminals divided to four groups, plate portions of a first group of terminals exposed upon the first mating face, plate portions of a second group of terminals exposed upon the second mating face, plate portions of a third group of terminals exposed upon the third mating face, plate portions of a fourth group of terminals exposed upon the fourth mating face;

wherein each of the first and second groups of terminals comprises grounding terminals and differential signal pairs, the plate portions of the differential signal pairs of the first and second groups have a length equal to 3.2 mm.

2. The plug electrical connector as claimed in claim 1, wherein the plate portions of the grounding terminals of the first group have a length equal to 3.7 mm, the plate portions of the grounding terminals of the second group have a length more than 3.7 mm.

3. The plug electrical connector as claimed in claim 2, wherein the mating tongue defines cutouts aligned with differential signal pairs one by one along a front face of the mating tongue, each cutout opens forwards and corresponding mating face so as to define a rear datum line, front edges of the contacting portions of the differential signal pairs are located behind the datum line.

4. The plug electrical connector as claimed in claim 3, wherein front edges of the contacting portion of grounding terminals of the first group of terminals are located behind the rear datum line, the contacting portions of the grounding terminals of the second group of terminals are located forward beyond the rear datum line.

5. The plug electrical connector as claimed in claim 4, wherein the terminals have a thickness equal to 0.15 mm.

6. The plug electrical connector as claimed in claim 1, wherein the terminals of the first group comprises body portions between the contacting portions and the connecting legs, the body portions are integrally molded with an insulating block behind the housing.

7. The electrical connector as claimed in claim 6, wherein the body portions define holes adjacent to the insulating housing.

* * * * *